US011789486B2

(12) United States Patent
Christlbauer et al.

(10) Patent No.: US 11,789,486 B2
(45) Date of Patent: Oct. 17, 2023

(54) SEALED THUMBWHEEL

(71) Applicant: elobau GmbH & Co. KG, Leutkirch (DE)

(72) Inventors: Richard Christlbauer, Legau (DE); Klaus Wild, Ochsenhausen (DE)

(73) Assignee: ELOBAU GMBH & CO. KG, Leutkirch (DE)

( * ) Notice: Subject to any disclaimer, the term of this patent is extended or adjusted under 35 U.S.C. 154(b) by 0 days.

(21) Appl. No.: 17/831,691

(22) Filed: Jun. 3, 2022

(65) Prior Publication Data

US 2022/0397929 A1 Dec. 15, 2022

(30) Foreign Application Priority Data

Jun. 10, 2021 (DE) ..... 202021103152.2

(51) Int. Cl.

| | |
|---|---|
| ***G05G 9/047*** | (2006.01) |
| ***G05G 25/04*** | (2006.01) |
| ***G05G 1/04*** | (2006.01) |
| ***G05G 5/05*** | (2006.01) |
| ***H01H 9/04*** | (2006.01) |

(52) U.S. Cl.

CPC ..... *G05G 9/047* (2013.01); *G05G 5/05* (2013.01); *G05G 25/04* (2013.01); *G05G 1/04* (2013.01); *G05G 2009/04781* (2013.01); *G05G 2505/00* (2013.01); *H01H 9/041* (2013.01)

(58) Field of Classification Search

CPC ..... G05G 1/04; G05G 5/05; G05G 9/047; G05G 25/04; G05G 2009/04781; G05G 2505/00; H01H 9/041

See application file for complete search history.

(56) References Cited

U.S. PATENT DOCUMENTS 2,929,258 A * 3/1960 Mackway ..... G01S 13/66 74/495
3,772,484 A 11/1973 Roeser
(Continued)

FOREIGN PATENT DOCUMENTS

DE 19757907 A1 7/1999
DE 10013630 C2 10/2002
DE 102015102317 A1 * 8/2016
(Continued)

*Primary Examiner* — Adam D Rogers

(74) *Attorney, Agent, or Firm* — Dickinson Wright PLLC

(57) ABSTRACT

An operating element for finger operation, which has an improved tightness against the ingress of dust and water with simultaneously increased degree of freedom of movement is provided. The operating element includes a thumbwheel, wherein the thumbwheel as an operating lever, which can be rotated about at least one first axis of rotation, a mounting box, wherein a point of intersection of the first axis of rotation with the thumbwheel is formed within the mounting box, as well as an integral sealing system having at least one seal. The sealing system and mounting box can be connected by a two-component injection molding. The mounting box has injection channels for injecting a material of the sealing system, in which corresponding injection channel connections of the sealing system are formed. The seals are connected to one another via the injection channel connections, and wherein a seal partially surrounds the operating lever.

4 Claims, 2 Drawing Sheets

(56) References Cited

U.S. PATENT DOCUMENTS

| | | | | |
|---|---|---|---|---|
| 6,549,113 | B1 | 4/2003 | Woodard | |
| 10,032,572 | B2 * | 7/2018 | Chen | H01H 13/10 |

FOREIGN PATENT DOCUMENTS

| | | | |
|---|---|---|---|
| EP | 0122465 | A2 | 10/1984 |
| EP | 3174081 | B1 | 4/2018 |
| EP | 3285275 | B1 | 1/2019 |

* cited by examiner

SEALED THUMBWHEEL

This U.S. utility patent application claims the benefit of DE patent application no. 202021103152.2, filed Jun. 10, 2021, the entire contents of which are incorporated herein by reference.

BACKGROUND

1. Technical Field

The invention elates to a sealed thumbwheel, in particular as operating element on an operating panel or a multi-function operating handle.

2. Related Art

Operating elements, which can be operated by means of slight finger movements, in the form of thumbwheels, are often used as control elements on or in operating panels, in particular in agricultural vehicles or machines or in the field of manufacturing technology. The combination of several operating elements on an operating panel or on a multi-function handle, such as a joystick, provides for the control of a large number of working procedures, devices, or machine functions via a single compact operating system.

With regard to their tightness against the ingress of dirt and water, the used control elements have to satisfy high requirements in particular in the field of agricultural machines and vehicles because the cleaning mostly takes place with high pressure and steam jet, and an ingress into the control electronics and mechanism must be prevented.

Known thumbwheels do not have a sufficient tightness, in particular when providing a sufficiently large maximum deflection angle.

Even though it is known, for example, from EP 3 174 081 B1 to further develop thumbwheels in the form of a joystick, a sufficient tightness cannot be attained by means of the disclosed system comprising several housing parts, which have a plurality of connecting edges with contact to the external environment as well as to the interior space, which is to be protected.

SUMMARY

It is thus the object of the invention to propose an operating element for the finger operation, which has an improved tightness against the ingress of dust and water, in particular in the case of high pressure cleaning with simultaneously increased degree of freedom of movement.

This object is solved by means of an operating element having a thumbwheel, wherein the thumbwheel has an operating lever, which can be rotated about at least one first axis of rotation, a mounting box, wherein a point of intersection of the first axis of rotation with the thumbwheel is formed within the mounting box, as well as an integral sealing system having at least one seal, wherein sealing system and mounting box are produced so as to be connected to one another by means of a substance-to-substance bond by means of a two-component injection molding, and wherein the mounting box has injection channels for injecting a material of the sealing system, in which corresponding injection channel connections of the sealing system are formed, wherein the seals are connected to one another via the injection channel connections, and wherein a seal is formed in the form of a bellows, which partially surrounds the operating lever along its longitudinal axis on contact surfaces.

By means of its integral nature as well as the substance-to-substance bond with the mounting box, the sealing system has a minimized number of connecting edges, which can be accessed from the outside and which are sources for the ingress of dirt and moisture. A tightness for the interior of the mounting box, in particular of the protection type IP 6K9K, is attained in an advantageous manner in this way. An efficient production of the sealing system in one piece is furthermore provided therewith via the known two-component injection molding process, which simplifies the further mounting. A connection of the sealing system to the mounting box has also already been created in the production of the sealing system, whereby connecting edges are avoided, in turn, as sources for the ingress of dirt and water. A loosening of the seals as a result of corrosion or wear is furthermore prevented. The service life of the sealing system is thus several millions of movement cycles. Within the injection channels of the mounting box, injection channel connections are made of a material of the sealing system, which simultaneously connect the individual seals to one another, during the two-component injection molding. The production process for the operating element according to the invention additionally provides for a respective optimized material selection for a stable mounting box and a flexible, durable sealing system.

The bellows provides for a sealed connection of the operating lever and thus of the entire thumbwheel to the mounting box, wherein a rotatory movability of the operating level remains to a large extent. A deflection of the operating lever by up to 30° relative to a zero position is possible thereby.

On its upper end, the connecting surface created along the longitudinal axis of the bellows thus has the single connecting edge of the operating lever to the external environment. This position of the connecting edge provides for a simple, additional seal by means of covering or sheathing.

Further static seals of the sealing system at points of intersection to other components or elements, for example to light guides or the mounting frame, which surrounds the operating element in an operating panel, are likewise provided.

In further development of the invention, it is provided that the bellows has exactly one fold. This provides for a sufficient movability and extendibility of the bellows with simultaneously material-compatible deformation and minimized cost of materials.

It is furthermore provided that the operating lever can be moved in a translatory manner along an axis of its zero position. The use of the bellows provides for a required compression and extension of the corresponding seal in a material-friendly manner. A further control variable can be linked to the operating lever in a highly advantageous manner by means of the translatory movability.

In embodiment of the invention, it is provided that the operating lever can be rotated about a second axis of rotation, which is formed perpendicular to the first axis of rotation. Compared to known thumbwheels, an additional degree of freedom of rotation is thus attained, which provides for a two-dimensional movement control or which provides for the control of a further component, respectively. In combination with the translatory movability, in particular a three-dimensional control is made possible.

In an embodiment of the invention, it is provided that the operating lever can be operated by means of a thumb of a user when firmly placing the hand on the mounting box, in the alternative also by means of an index finger. This provides in particular for the integration of the operating element into an operating panel, in the case of which further control systems of the vehicle or of the machine can be controlled by means of movement of the entire hand.

It is additionally also provided that an operating head of the operating lever partially surrounds the bellows in the form of a projection along the axial position of the contact surfaces. The end of the bellows is efficiently closed against a direct ingress of dirt or water in this way.

In further development of the invention, it is provided that the operating lever is arranged on a sliding system, wherein the sliding system has at least a first sliding part and restoring means, which act on the at least one sliding part and transfer the latter to a zero position, and wherein the operating lever is guided in the sliding system, wherein the first sliding part is movably mounted in such a way that a positional change of the operating lever with respect to the sliding system results in a movement of the at least one sliding part in the direction of the restoring means acting on the at least one sliding part.

An operating element comprising sliding system is thus proposed, which provides for the use of a rigid operating lever without separate restoring means. Sliding system and operating lever thereby act as thumbwheel. The at least one sliding part forms a slide for the operating lever guided therein, wherein the slide exerts a restoring force, which is changed depending on the position of the operating lever, on the latter. For the generation of the restoring force, the invention has restoring means, which act on the at least one sliding part, which has a correspondingly formed sliding track, so that the operating lever can be a simple, inherently rigid lever. A zero position of the operating lever, into which the operating lever is returned in the absence of a deflection, is defined by means of the restoring forces. According to the invention, this deflection is a pushing movement in a direction radially to the pivoting movement of the operating lever, as well as the pivoting movement thereof about at least one pivot axis. In the alternative or in addition, it also comprises a displacement of the lever similarly as in the case of a commercially available manual vehicle control, or a pulling movement in the direction radially to the pivoting movement of the operating lever.

The operating element according to the invention is a sealed operating element produced by means of an injection molding process, comprising a thumbwheel, the sealing of which of the inner elements against external influences is improved due to a minimized number of connecting surfaces of mounting box, sealing system, and operating element in such a way that a tightness of the protection class IP 6K9K is attained. The materials used for the two components are adapted to the function of the respective injected element, whereby a stable material can be used for the injection molding of the mounting box, and a more flexible material can simultaneously be used for the injection molding of the sealing system, which provides in particular for the use of a bellows as part of the sealing system for sealing and connecting to operable parts of the operating element.

BRIEF DESCRIPTION OF THE DRAWINGS

The invention will be described in more detail below with reference to two figures, in which.

DETAILED DESCRIPTION OF EXAMPLE EMBODIMENTS

Figure 1:
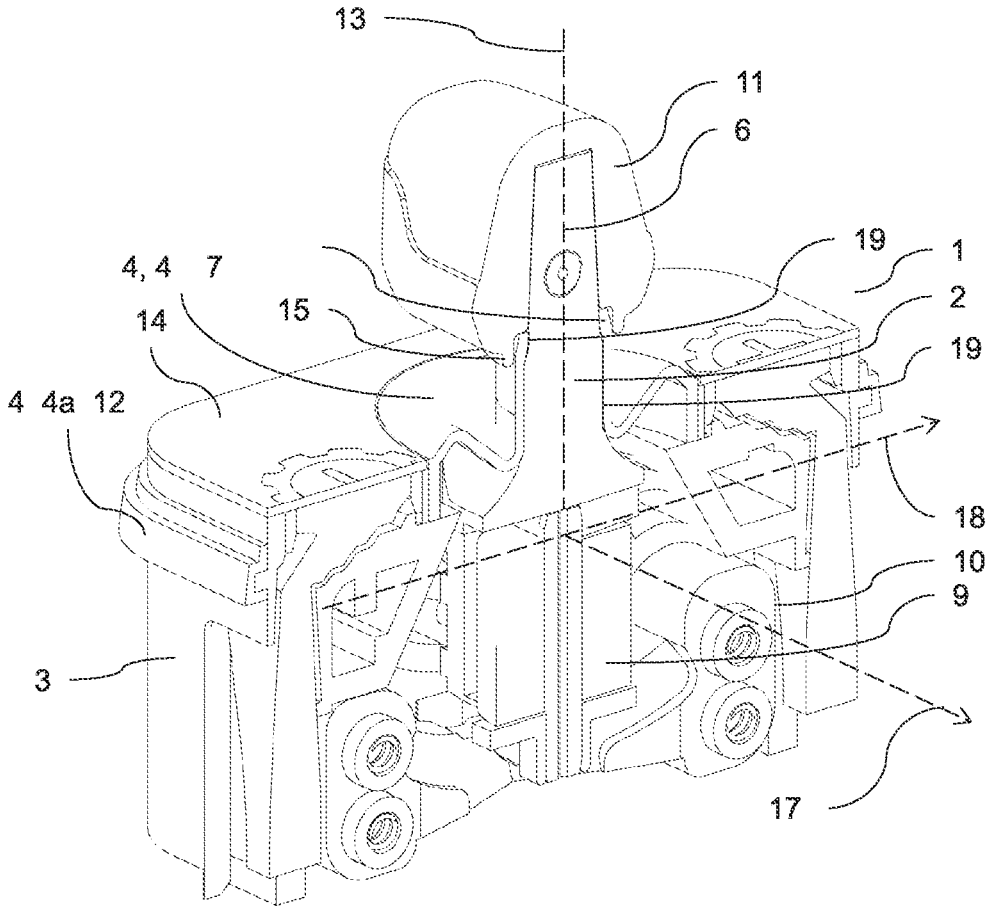
FIG. 1: shows a sectional drawing of an embodiment of a sealed operating element according to the invention

FIG. 1 shows a section through an operating element 1 according to the invention. Arranged on an outer mounting box 3, several seals 4 of an integral sealing system 4*a* are located. Mounting box 3 and seating system 4*a* are thereby produced by means of two-component injection molding and are connected by means of a substance-to-substance bond. An operating lever 2 comprising sliding system is arranged relative to the mounting box 3 in such a way that a point of intersection of a first axis of rotation 17 of a rotational movement of the operating lever 2 with the operating lever 2 is arranged within the mounting box 3, wherein the operating lever 2 is guided in the sliding system. The operating lever 2 is thereby mounted in the sliding system so as to be capable of moving along a pivot axis. The shown embodiment furthermore provides for a rotational movement about a second axis of rotation 18, which is formed perpendicular to the first axis of rotation 17. In responding to the deflection of the operating lever 2 from a zero position 13, the sliding system transfers a restoring force to said operating lever. The restoring force is generated by means of restoring means 10, wherein restoring means 10 and sliding system are arranged within the mounting box 3. In this embodiment, the thumbwheel 9 is thus embodied as sliding system comprising operating lever 2. What is illustrated is an embodiment, in the case of which the sealing system 4*a* has a connecting seal 12 surrounding the mounting box 3. Said connecting seal serves as seal 4 when the sealed operating element 1 is installed in an operating panel. To connect the mounting box 3 to the operating lever 2, the connecting device 4*a* has a bellows 7. The latter provides for a sealing of the interior of the mounting box 3 and thus of the movable mechanism and electronics of the operating element 1 with simultaneously attained movability of the operating lever 2, which the bellows 7 contacts along a longitudinal axis 6 of the operating lever 2 on contact surfaces 19. Due to the flexibility and extensibility of the bellows 7, degrees of freedom of rotation and translation of the operating lever 2 are maintained to a large extent, whereby deflection angles of up to 30° from the zero position 13 of the operating lever 2 and a deflection of up to 1 mm along an axis of the zero position 13 are made possible. In the shown embodiment, the bellows 7 has a fold, which provides for the above-mentioned sufficient rotatory and translatory movability of the sealed operating lever 2, in the case of which a stress on a sealing material is still limited in such a way that four million movement cycles of the operating lever 2 can be ensured. An operating head 11 is arranged on an operating-side end of the operating lever 2. Said operating head represents the actuating element when using the operating lever 2. Along the longitudinal axis 6, the operating head 11 is thereby designed as projection 15, so that is covers a bellows end 8 and thus also the contact surfaces 19. This provides for a protection against the ingress of dirt and water at the critical transition between seal 4 and operating lever 2. Due to the formation of the projection 15, an ingress is not possible via the straight path of a particle, but only via scattering at several points. A cover 14, through which the bellows 7 passes, is arranged on a horizontal end surface of the mounting box 3.

Figure 2:
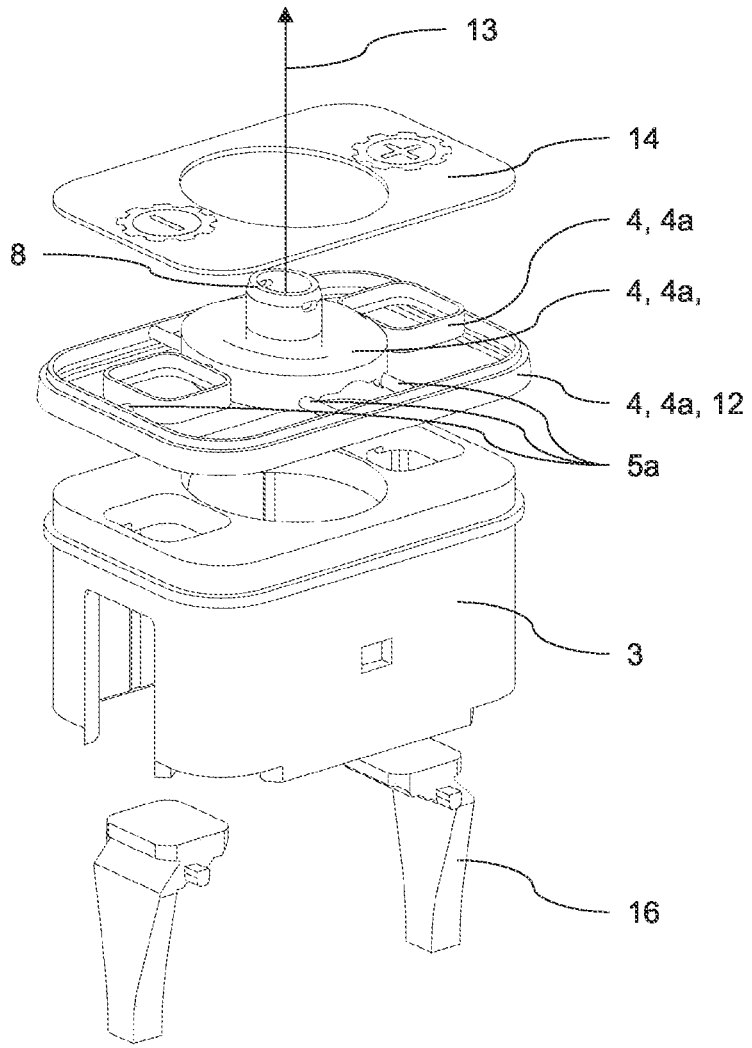
FIG. 2: shows an exploded illustration of an embodiment of a mounting box according to the invention comprising a sealing system.

FIG. 2 is an exploded illustration of the elements cover 14, sealing system 4*a*, of a light guide 16 that can be inserted into side walls of the mounting box 3, and mounting box 3 itself. The integral sealing system 4*a* is formed from various seals 4, such as the connecting seal 12 arranged around the mounting box 3, and a bellows 7. The individual seals 4 are connected via injection channel connections 5*a*. The latter are formed by injecting the material of the sealing system 4*a* into injection channels 5, which are provided within the material of the mounting box 3 and which are not illustrated here. The injection channel connections 5*a* are thus formed within the injection channels 5 during the injection molding of the sealing system 4*a*. An integral sealing system 4*a* as well as an operating element 1 is attained in this way, in the case of which mounting box 3 and sealing system 4*a* are connected to one another by means of a substance-to-substance bond.

The invention claimed is:

1. An operating element having a thumbwheel, wherein the thumbwheel has an operating lever, which can be rotated about at least one first axis of rotation by up to 30° relative to a zero position, a mounting box with a light guide, wherein a point of intersection of the first axis of rotation with the thumbwheel is formed within the mounting box, as well as an integral sealing system having at least one seal, wherein the sealing system and the mounting box are produced so as to be connected to one another by a substance-to-substance bond by a two-component injection molding, and wherein the mounting box has injection channels for injecting a material of the sealing system, in which corresponding injection channel connections of the sealing system are formed, wherein if more than one of the at least one seal is present, then the seals are connected to one another via the injection channel connections, and wherein the at least one seal forms a bellows, which partially surrounds the operating lever along its longitudinal axis on contact surfaces, wherein an operating head of the operating lever partially surrounds the bellows in the form of a projection along an axial position of the contact surfaces, whereby the operating lever can be moved in a translatory manner along an axis of its zero position and whereby the sealing system comprises static seals at points of intersection to the light guides.

2. The operating element according to claim 1, wherein the bellows has exactly one fold.

3. The operating element according to claim 1, wherein the operating lever can be rotated about a second axis of rotation, which is formed perpendicular to the first axis of rotation.

4. The operating element according to claim 1, wherein the operating lever can be operated by a thumb or an index finger of a user when placing the hand on the mounting box.

* * * * *